US008157460B2

(12) United States Patent
Masuda et al.

(10) Patent No.: US 8,157,460 B2
(45) Date of Patent: Apr. 17, 2012

(54) ROLL PAPER PRINTER HAVING AN AUTOMATIC PAPER CUTTER, AND RELATED PRINTER CONTROL METHOD AND CONTROL PROGRAM

(75) Inventors: Ichimi Masuda, Shiojiri (JP); Hiroyuki Motoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1030 days.

(21) Appl. No.: 12/050,707

(22) Filed: Mar. 18, 2008

(65) Prior Publication Data

US 2008/0304895 A1 Dec. 11, 2008

(30) Foreign Application Priority Data

Mar. 19, 2007 (JP) ..... 2007-070489

(51) Int. Cl.
*B41J 11/70* (2006.01)

(52) U.S. Cl. ..... 400/621; 400/582; 400/583; 400/611

(58) Field of Classification Search ..... 400/621, 400/582, 583, 611
See application file for complete search history.

(56) References Cited

U.S. PATENT DOCUMENTS

| | | | | | |
|---|---|---|---|---|---|
| 2,629,440 | A | * | 2/1953 | Shaw et al. | 83/243 |
| 4,119,255 | A | * | 10/1978 | D'Angelo | 226/136 |
| 5,382,105 | A | | 1/1995 | Iguchi et al. | |
| 6,145,423 | A | * | 11/2000 | Boreali et al. | 83/145 |
| 6,189,428 | B1 | * | 2/2001 | Hoshino | 83/147 |
| 6,296,406 | B1 | * | 10/2001 | Kurashina | 400/615.2 |
| 6,732,626 | B2 | * | 5/2004 | Hong | 83/649 |
| 6,914,688 | B2 | * | 7/2005 | Inana | 358/1.12 |
| 2003/0085986 | A1 | * | 5/2003 | Sasaki | 347/254 |
| 2004/0163511 | A1 | * | 8/2004 | Shinga | 83/13 |

FOREIGN PATENT DOCUMENTS

| | | | | |
|---|---|---|---|---|
| JP | 54084418 | A | * | 7/1979 |
| JP | 61137456 | A | * | 6/1986 |
| JP | 04301476 | A | * | 10/1992 |
| JP | 5-77504 | | | 3/1993 |
| JP | 11-309912 | | | 11/1999 |
| JP | 2000001248 | A | * | 1/2000 |
| JP | 2003001889 | A | | 1/2003 |
| JP | 2003054059 | A | * | 2/2003 |
| JP | 2003-246108 | | | 9/2003 |
| JP | 2003246108 | A | | 9/2003 |
| JP | 2006341539 | A | * | 12/2006 |

* cited by examiner

*Primary Examiner* — Daniel J Colilla

(74) *Attorney, Agent, or Firm* — Nutter McClennen & Fish LLP; John J. Penny, Jr.; Christina M. Sperry

(57) ABSTRACT

A printer that uses roll paper as the printing medium and has a manual feed button and an automatic paper cutter detects if the manual feed button was operated. If the manual feed button was operated, the paper is advanced a prescribed length, and the paper is cut by the automatic paper cutter after advancing the paper stops.

5 Claims, 7 Drawing Sheets

ROLL PAPER PRINTER HAVING AN AUTOMATIC PAPER CUTTER, AND RELATED PRINTER CONTROL METHOD AND CONTROL PROGRAM

Priority is claimed under 35 U.S.C. §119 from Japanese Patent Application No. JP2007-070489 filed on Mar. 19, 2007, which is hereby incorporated by reference in its entirety.

BACKGROUND OF THE INVENTION

1. Field of Invention

The present invention relates to a printer, a printer control method, and to a printer control program, and relates more particularly to a printer that has an automatic paper cutter and is used in a point-of-sale (POS) system, to a control method for the printer, and to a control program.

2. Description of Related Art

Compact printers with an automatic paper cutter, including thermal printers and dot impact printers as taught in Japanese Unexamined Patent Appl. Pub. JP-A-H05-077504, have conventionally been used in POS systems for printing receipts.

Receipt printers of this type typically use roll paper, that is, a continuous paper tape that is wound in a roll, because roll paper enables the efficient storage of the printing paper in a confined space.

During actual use, the purchased products, product prices, total amount, and other information is printed on the paper as the paper is pulled off the roll, and the paper is then cut by an automatic paper cutter inside the printer when printing is completed. The automatic paper cutter may completely sever the printed portion of the paper (full-cut), or leave a portion of the paper uncut (partial cut).

With the prior art compact printer described above, the user, such as a cash register operator, may also pull a length of paper off the roll to write a memo or note as may be necessary.

The foregoing automatic paper cutter operates after printing, however, and does not operate when the paper is advanced by pressing a feed button. As a result, the paper may become skewed and jam when the user forcibly pulls and tears off the paper, and the user must take time to rethread the paper or correct the paper jam.

SUMMARY OF THE INVENTION

The invention provides a printer that prevents paper jams and enables uninterrupted use even when the user manually pulls the roll paper out to use the paper, a control method for the printer, and a control program.

A first aspect of at least one embodiment of the invention is a printer that uses roll paper as printing paper and has an automatic paper cutter, wherein when a prescribed actuator is operated, the printing paper is advanced a prescribed length and then cut by the automatic paper cutter.

This aspect of the invention advances the printing paper a prescribed length when the prescribed actuator is operated, and then automatically cuts the paper. As a result, paper jams do not occur when the user manually removes a length of paper from the roll.

The prescribed length can be determined based on the operating state of the actuator.

This enables the user to achieve the desired length of paper with the length controlled by operating the actuator.

The operating state can be the number of times or the length of time the actuator is operated.

This enables the user to know intuitively how to operate the actuator in order to obtain the desired length of paper.

In another aspect of at least one embodiment of the invention, when the prescribed actuator is operated and the prescribed actuator is then operated again within a prescribed time, the printing paper is again advanced a prescribed length before being cut by the automatic paper cutter.

This aspect of the invention enables the user to achieve the desired length of paper even if operation of the actuator is interrupted intentionally or accidentally.

In another aspect of at least one embodiment of the invention, when the prescribed actuator is operated, the printing paper is advanced a prescribed length and then cut by the automatic paper cutter without the prescribed actuator being operated again.

This aspect of the invention enables the user to achieve a prescribed length of paper by simply operating the actuator once and without needing to continue operating the actuator.

In another aspect of at least one embodiment of the invention, if the prescribed actuator is operated, the printing paper is advanced a prescribed length, and the prescribed actuator is still being operated, the printing paper continues to be advanced until the prescribed actuator is released, and the printing paper is then cut by the automatic paper cutter.

This aspect of the invention enables the user to obtain a length of paper a desired length longer than the prescribed length.

The prescribed actuator can be a manual feed button for feeding the printing paper.

This enables the user to know intuitively how to operate the actuator.

Another aspect of at least one embodiment of the invention is a control method for a printer that uses roll paper as printing paper and has an actuator and an automatic paper cutter, comprising determining if a prescribed actuator was operated; advancing the printing paper a prescribed length if the prescribed actuator was operated; and automatically cutting the printing paper by an automatic paper cutter after paper transportation ends.

This aspect of the invention advances the printing paper a prescribed length when the prescribed actuator is operated, and then automatically cuts the paper. As a result, paper jams do not occur when the user manually removes a length of paper from the roll.

Another aspect of at least one embodiment of the invention is a control program whereby a computer controls a printer that uses roll paper as printing paper and has an actuator and an automatic paper cutter, that executes the steps of: determining if a prescribed actuator was operated; advancing the printing paper a prescribed length if the prescribed actuator was operated; and automatically cutting the printing paper by an automatic paper cutter after paper transportation ends.

This aspect of the invention advances the printing paper a prescribed length when the prescribed actuator is operated, and then automatically cuts the paper. As a result, paper jams do not occur when the user manually removes a length of paper from the roll.

The control program can be recorded on a computer-readable recording medium.

The invention thus automatically cuts the paper even when the user manually removes a length of paper for use. The user therefore does not need to tear the paper off and the printer can continue to operate normally.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of the present invention is described below with reference to the accompanying figures.

The printer 1 uses roll paper 20, that is, paper wound in a roll, as the printing paper, and prints an image including text by spraying liquid color ink onto the printing surface of the roll paper.

Figure 1:
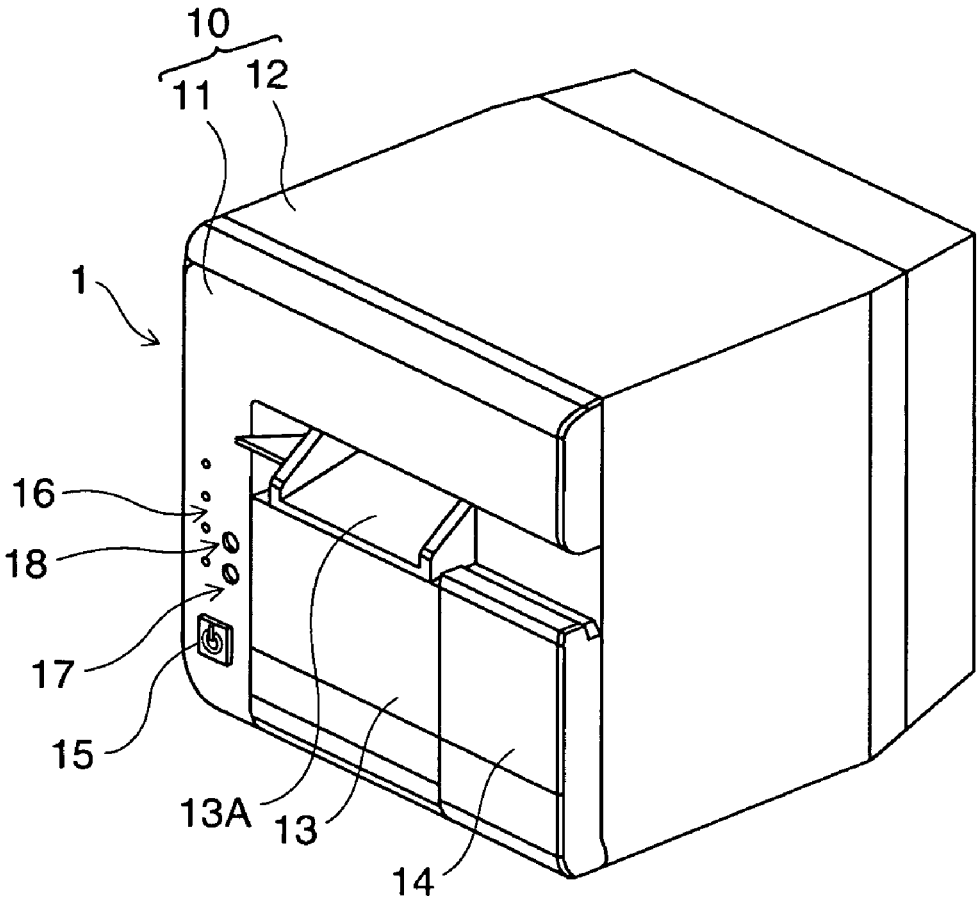
FIG. 1 is an oblique view of a printer according to a preferred embodiment of the invention.

As shown in FIG. 1 the main case 10 of the printer 1 includes a front panel 11 disposed at the front of the printer 1, and a box-like case cover 12.

A roll paper compartment cover 13 and a cartridge loading unit cover 14 that can open and close are disposed to the front panel 11. An operating panel 18 is located on one side of the front panel 11. A power switch 15 for turning the printer 1 on and off, a display unit 16 having LEDs, for example, that light steady or blink according to the operating state of the printer 1, a manual feed button 17 for advancing the roll paper 20, and other switches and buttons are disposed to the operating panel 18.

A paper exit 13A for discharging the printed roll paper 20 is open at the top part of the roll paper compartment cover 13.

Figure 2:
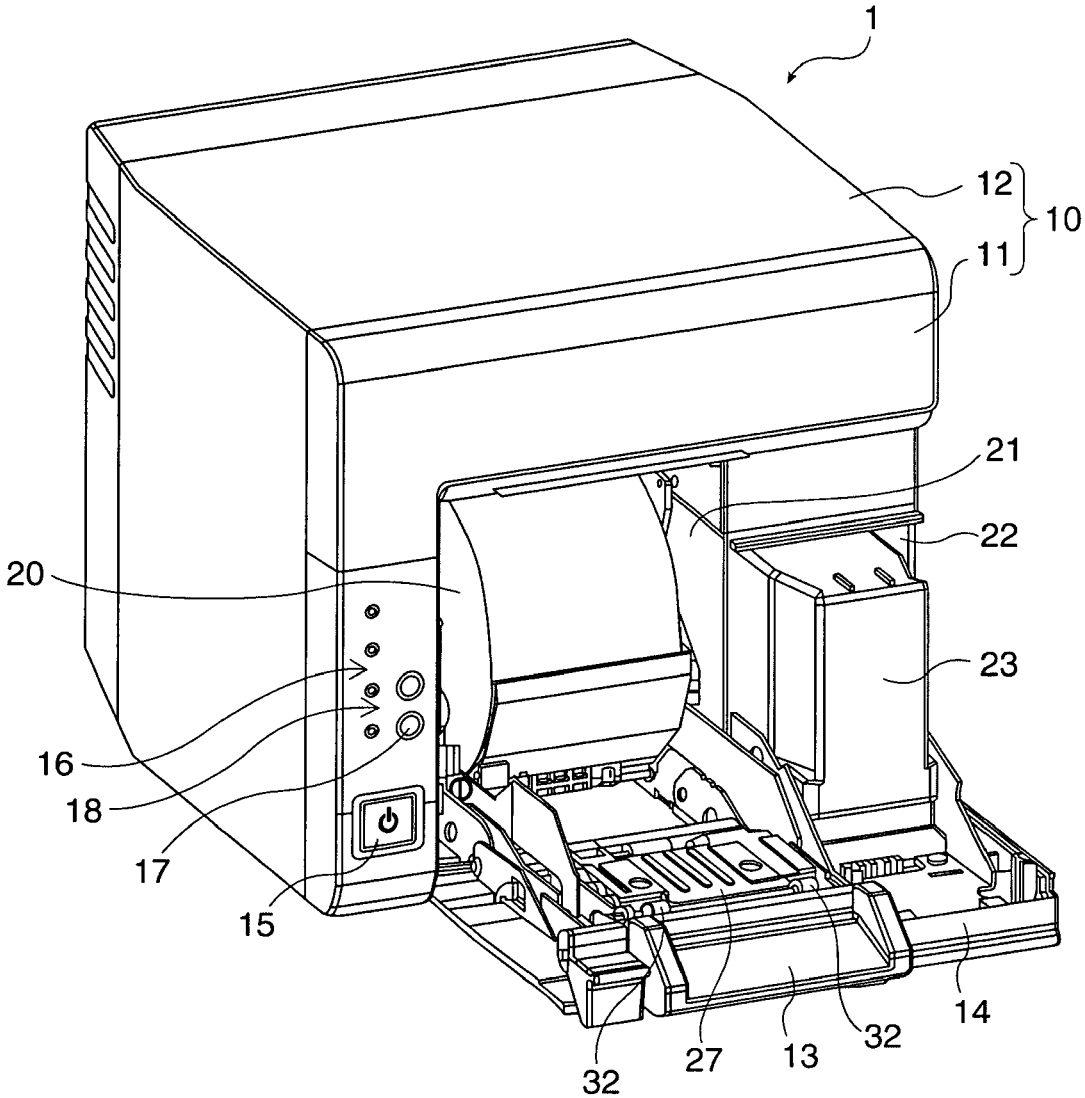
FIG. 2 is an oblique view of the printer shown in FIG. 1 with the roll paper compartment cover and the cartridge loading unit cover open.

FIG. 2 is an oblique view of the printer shown in FIG. 1 with the roll paper compartment cover 13 and the cartridge loading unit cover 14 open.

As shown in FIG. 2, a roll paper compartment 21 for storing the roll paper 20 is formed on the inside of the roll paper compartment cover 13. Opening the roll paper compartment cover 13 to the front as shown in FIG. 2 exposes the roll paper 20 so that the paper can be replaced or loaded.

A cartridge loading unit 22 is formed on the inside of the cartridge loading unit cover 14, and an ink cartridge 23 is loaded in the cartridge loading unit 22. The ink cartridge 23 holds four ink packs (not shown in the figure) holding the four colors of liquid ink that are used in the printer 1, specifically black, cyan, magenta, and yellow in this embodiment. The ink cartridge 23 also has a waste ink holding unit (not shown in the figure) for storing waste ink. The ink cartridge 23 is removably loaded in the printer 1, and the ink cartridge 23 can be replaced or loaded by opening the cartridge loading unit cover 14 to the front.

Figure 3:
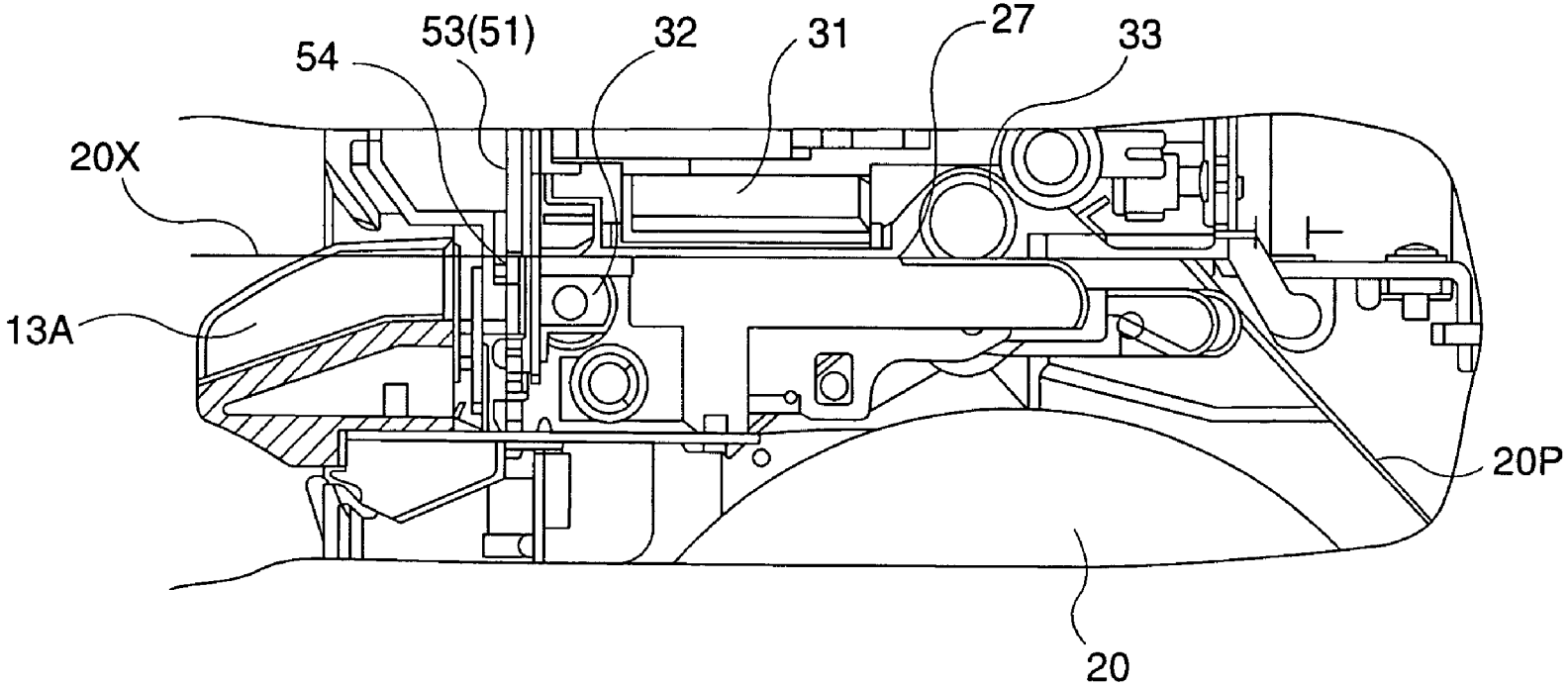
FIG. 3 is a section view showing the main parts of the printer.

FIG. 3 is a section view showing the main parts of the printer.

A print head 31, a front roller 32, and a transportation roller 33 are disposed inside the printer 1. The print head 31 discharges ink to actually print. The front roller 32 conveys the roll paper 20X toward the paper exit 13A. The transportation roller 33 advances the roll paper 20P inside the printer 1 toward the platen 27. As used herein, roll paper 20X refers to the roll paper 20 after it has been printed, and roll paper 20P refers to the roll paper 20 before it is printed.

A first movable blade 51, a second movable blade 53, and a stationary blade 54 forming an automatic paper cutter described below for automatically cutting the roll paper 20X is disposed on the paper exit 13A side of the front roller 32.

Figure 4:
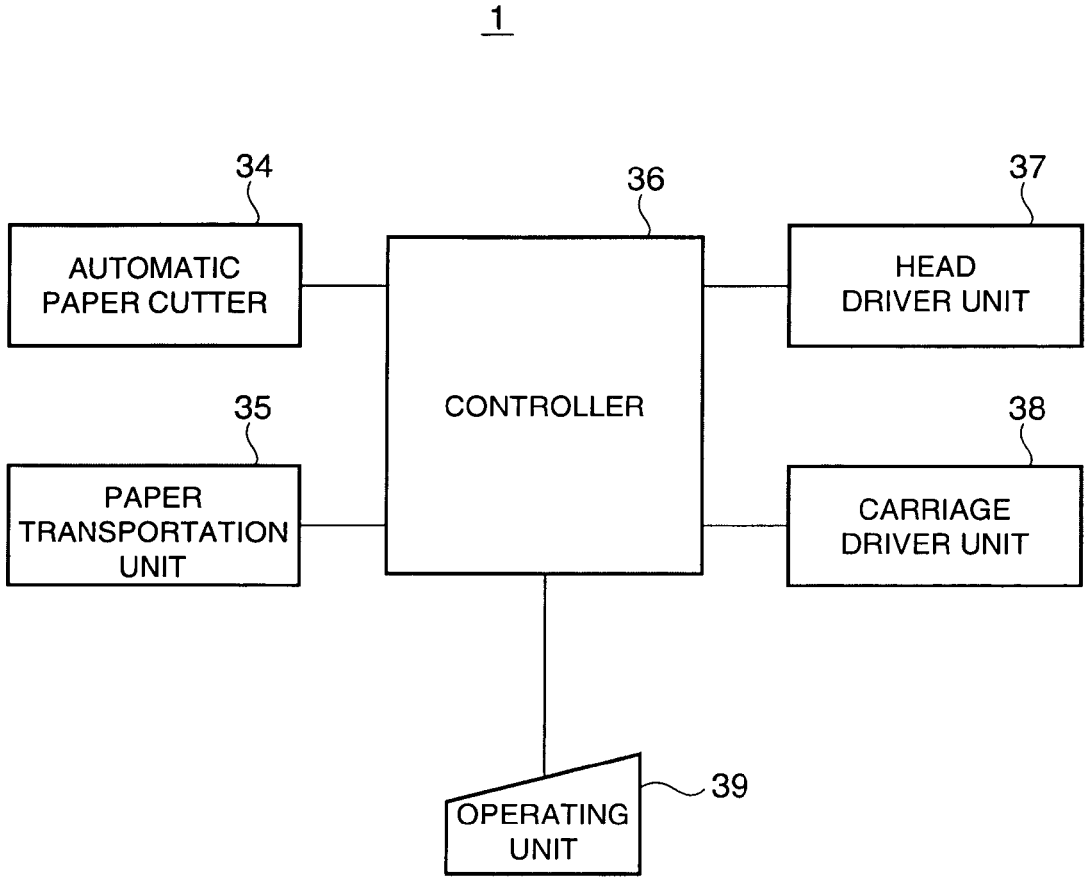
FIG. 4 is a schematic block diagram of the printer control system.

FIG. 4 is a schematic block diagram of the printer control system.

The printer 1 has an automatic paper cutter 34, a paper transportation unit 35, a controller 36, a head driver unit 37, a carriage driver unit 38, and an operating unit 39 that includes the operating panel 18.

The automatic paper cutter 34 automatically cuts (including partially cutting) the roll paper 20. The paper transportation unit 35 includes the front roller and the transportation roller 33 for conveying the roll paper 20. The controller 36 includes a CPU, ROM, and RAM not shown and controls operation of the printer 1. The head driver unit 37 drives the print head 31, and the carriage driver unit 38 drives a carriage on which the print head 31 is disposed.

This printer 1 is connected to a host computer by a communication interface not shown.

Figure 5:
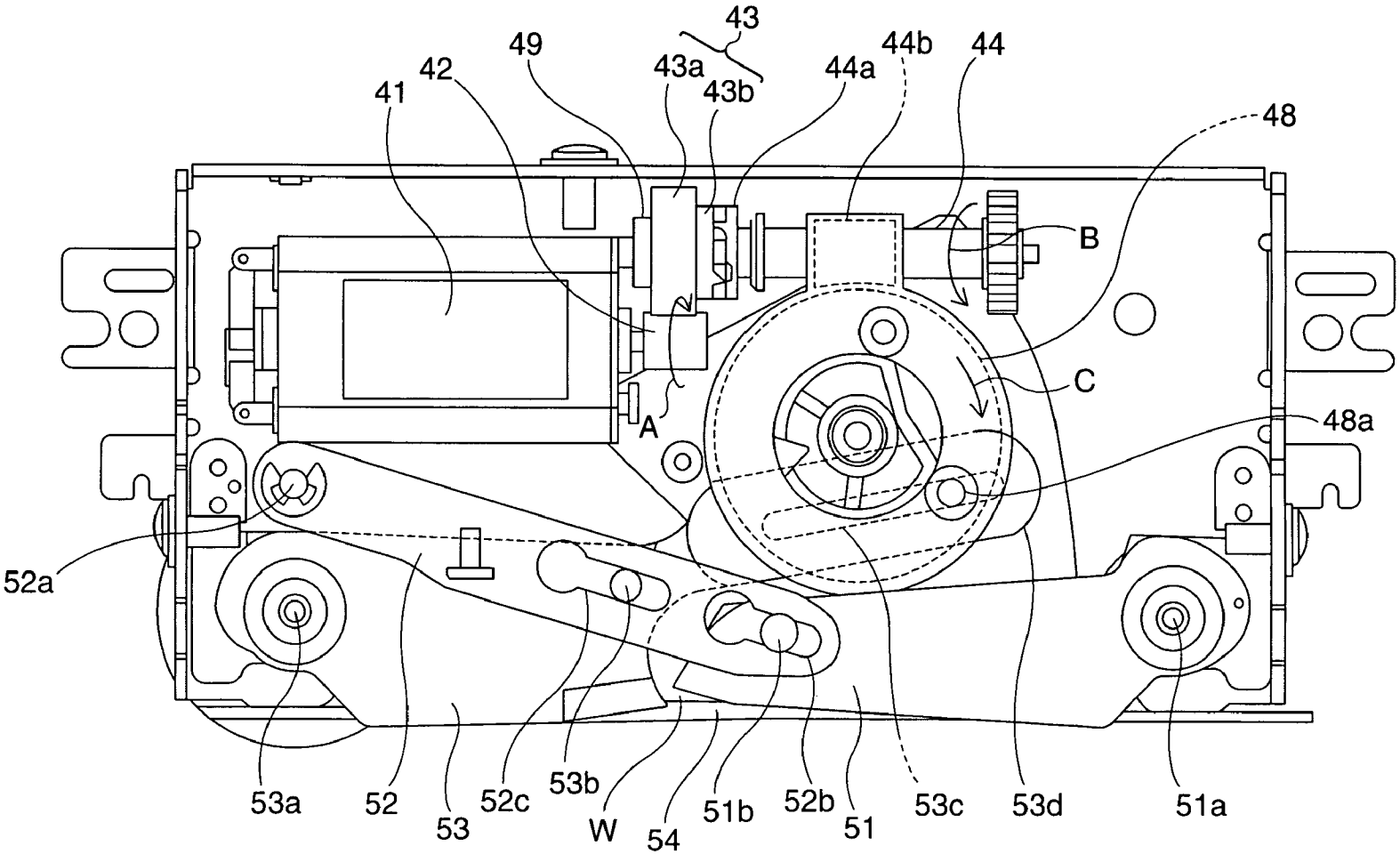
FIG. 5 is a front view of the automatic paper cutter in the paper cutting mode.

FIG. 5 is a frontal view of the automatic paper cutter when cutting paper.

The automatic paper cutter 34 has a motor 41 as the drive power source. A motor gear 42, which is a spur gear, is inserted on the motor shaft of the motor 41. The motor gear 42 meshes with a larger gear 43*a* that is also a spur gear. A first sawtooth-shaped tooth 43*b* is formed in unison with the large gear 43*a*, and is disposed to move along the axis of rotation. The large gear 43*a* and first sawtooth-shaped tooth 43*b* form a transmission gear 43.

A worm shaft 44 is disposed coaxially to the axis of rotation of the transmission gear 43, and has a worm 44*b* and a second sawtooth-shaped tooth 44*a* formed in unison. The second sawtooth-shaped tooth 44*a* meshes with the first sawtooth-shaped tooth 43*b*. Movement of one end of the worm shaft 44 is limited by a frame not shown. A helical gear 48 supported freely rotatably on a support shaft engages and is rotated by the worm 44*b* of the worm shaft 44.

A drive pin 48*a* for driving the first movable blade 51, linkage member 52, and second movable blade 53 as described below is disposed to the helical gear 48.

A compression spring 49 urges the transmission gear 43 so that the first sawtooth-shaped tooth 43*b* and second sawtooth-shaped tooth 44*a* of the transmission gear 43 and worm shaft 44 engage.

One end of the first movable blade 51 pivots freely on a support pin 51*a*, and first movable blade drive pin 51*b* projects from the side of the first movable blade 51.

One end of the second movable blade 53 pivots freely on a support pin 53*a*, and second movable blade drive pin 53*b* projects from the side of the second movable blade 53.

A drive plate 53*d* with a track channel 53*c* extends from the distal end side of the second movable blade 53 to the helical gear 48, and the drive pin 48*a* of the helical gear 48 is held freely slidably in the track channel 53*c*.

One end of the linkage member 52 pivots freely on a support pin 52*a*. The linkage member 52 has a first track channel 52*b* that engages the first movable blade drive pin 51*b* and slidably supports the first movable blade drive pin 51*b*, and a second track channel 52*c* that engages the second movable blade drive pin 53*b* and slidably supports the second movable blade drive pin 53*b*.

A stationary blade 54 is located below the first movable blade 51 and the second movable blade 53.

Operation of the automatic paper cutter is described next.

When a drive voltage is applied to the motor 41, the motor 41 turns in the direction of arrow A, and the motor gear 42 also turns in the direction of arrow A. The transmission gear 43 that meshes with the motor gear 42 therefore turns in the direction of arrow B.

As a result, the worm shaft 44 that meshes with the transmission gear 43 also turns in the direction of arrow B, and the helical gear 48 rotates in the direction of arrow C at a speed greatly reduced by the worm 44*b*.

The drive pin 48*a*, which is disposed on the helical gear 48 rotating in the direction of arrow C, thus moves to the left as seen in FIG. 5 inside the track channel 53*c* of the drive plate 53*d*. This causes the second movable blade 53 to pivot on the support pin 53*a* so that the distal end part of the second movable blade moves down, the second movable blade drive pin 53*b* slides to the right inside the second track channel 52*c*, and the linkage member 52 pivots on the support pin 52*a* and moves down.

As a result, the first movable blade drive pin 51*b* of the first movable blade 51 also slides to the right inside the first track channel 52*b*, the first movable blade 51 pivots on the support pin 51*a*, and the distal end of the first movable blade 51 moves down.

As a result, the roll paper 20 located between the first movable blade 51 and second movable blade 53 and the stationary blade 54 is cut.

The knives are arranged so that a gap w is left between the blade tip on the distal end of the first movable blade 51 and the stationary blade 54. This results in the roll paper 20 being partially cut so that it can be easily removed by the user.

The roll paper 20 is conveyed by the transportation mechanism while being printed by the printer. The roll paper 20 is also cut in this embodiment of the invention after the manual feed button 17 is pressed to advance the unprinted roll paper 20 to the desired position.

When the helical gear 48 rotates forward after the roll paper 20 is cut and a detector not shown detects that the first movable blade 51 and second movable blade 53 have returned to the initial position (home position), the controller 36 that controls both the driving of and the direction of rotation of the motor 41 stops supplying current to the motor 41, and thus ends the paper cutting operation of the automatic paper cutter 34.

Operation when the manual feed button 17 is operated is described next.

Figure 6:
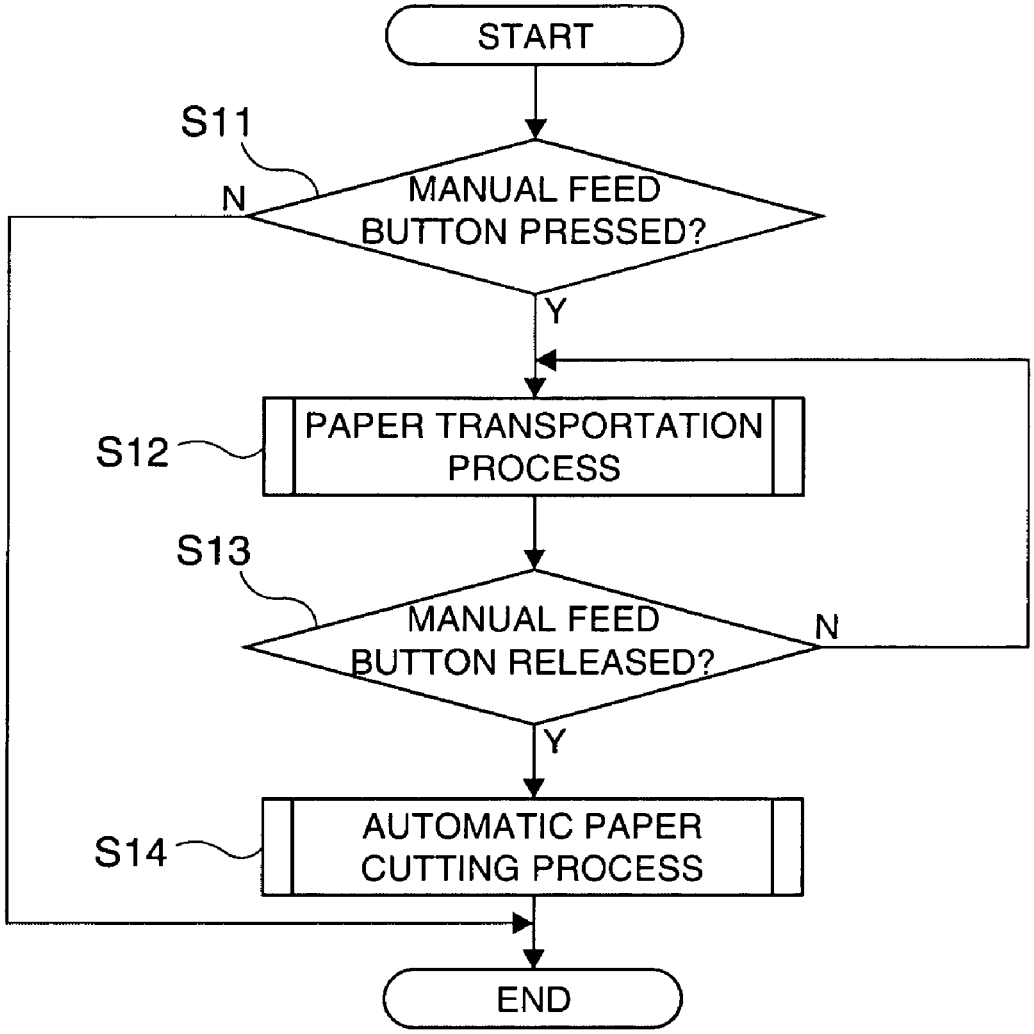
FIG. 6 is a flow chart of the process executed when the manual feed button is operated.

FIG. 6 is a flow chart of the operation when the manual feed button is pressed.

The controller 36 first determines if the manual feed button 17 was pressed by the user (step S11).

If the controller 36 determines in step S11 that the manual feed button 17 has not been pressed (step S11 returns No), the process ends.

If the controller 36 determines in step S11 that the manual feed button 17 was pressed (step S11 returns Yes), the controller 36 controls the paper transportation unit 35 to advance the roll paper 20 (step S12).

The controller 36 then determines if the manual feed button 17 has been released (step S13).

If the manual feed button 17 has not been released in step S13, that is, the manual feed button 17 is still depressed, control returns to step S12 and advancing the roll paper 20 continues.

If the manual feed button 17 has been released in step S13, the controller 36 controls the automatic paper cutter 34 to partially cut the roll paper 20 (step S14) so that the paper can be easily separated and removed by the user.

This operation results in the roll paper 20 being partially cut after the roll paper 20 has been advanced to the desired cutting position in response to the operating time of the manual feed button 17.

Because the roll paper 20 can then be removed without the user pulling forcefully on the paper, the roll paper 20 will not become skewed and jammed inside the printer 1.

Operation according to another control method when the manual feed button 17 is operated is described next.

Figure 7:
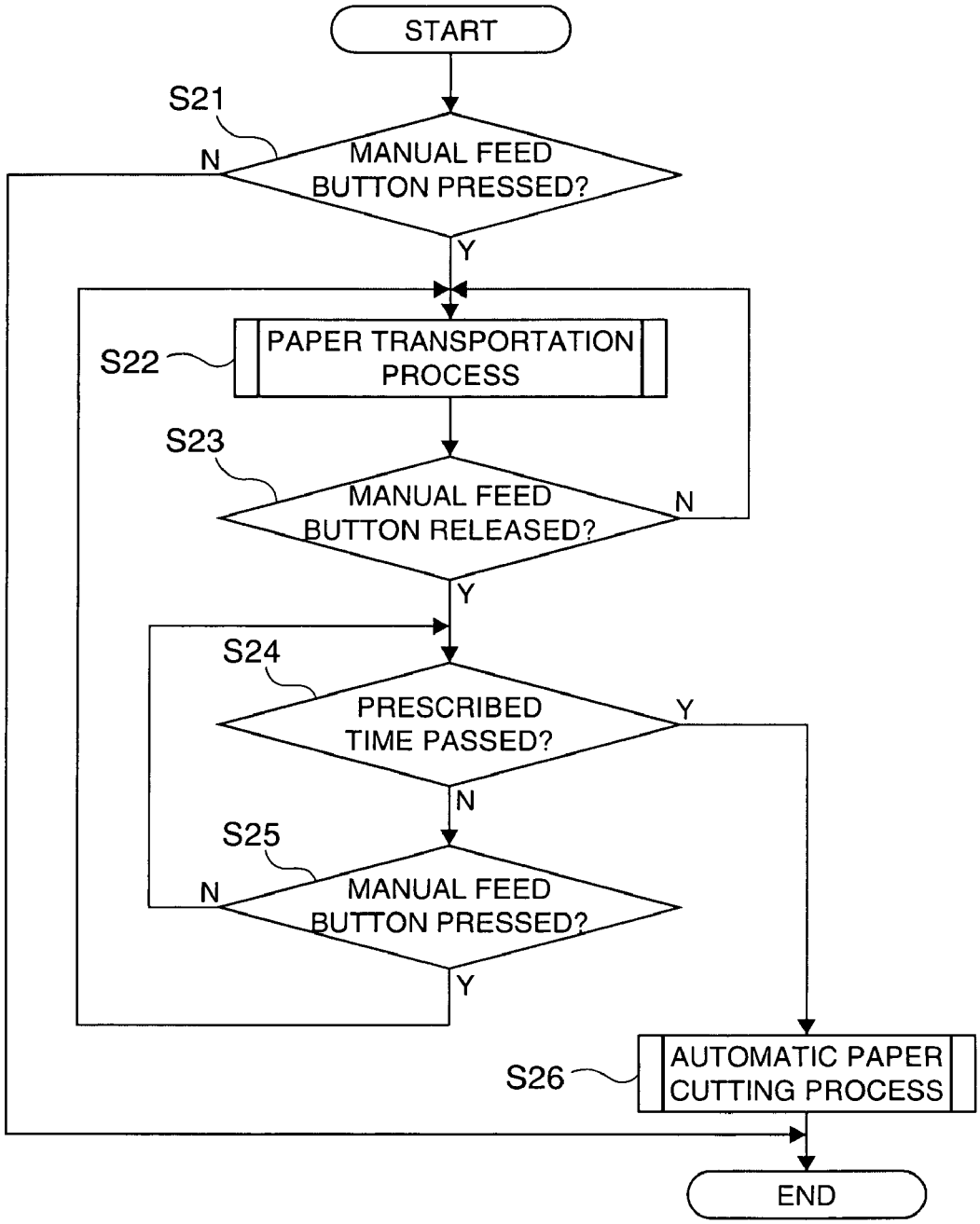
FIG. 7 is a flow chart of another process executed when the manual feed button is operated.

FIG. 7 is a flow chart of an alternative process that is executed when the manual feed button is operated.

With the operation described in the flow chart shown in FIG. 6, the roll paper is cut when the manual feed button 17 is released, and the paper may therefore not be cut to the desired length. The operation described in the flow chart in FIG. 7, however, enables the user to easily change the cut length of the roll paper.

The controller 36 first determines if the manual feed button 17 was pressed by the user (step S21).

If the controller 36 determines in step S11 that the manual feed button 17 has not been pressed (step S21 returns No), the process ends.

If the controller 36 determines in step S21 that the manual feed button 17 was pressed (step S21 returns Yes), the controller 36 controls the paper transportation unit 35 to advance the roll paper 20 (step S22).

The controller 36 then determines if the manual feed button 17 has been released (step S23).

If the manual feed button 17 has not been released in step S23, that is, the manual feed button 17 is still depressed, control returns to step S22 and advancing the roll paper 20 continues.

If the manual feed button 17 has been released in step S23, the controller 36 determines if a prescribed standby time has passed since the manual feed button 17 was released (step S24). This standby time is provided so that the paper is not cut immediately when the manual feed button 17 is released, and the user can change the cutting position (to increase the length of the portion that is cut off). This prescribed standby time could be set by the user within a range of a specific number of seconds (such as from one to five seconds), or the time could be preset in the factory.

If the prescribed standby time has not passed in step S24 (step S24 returns No), whether the user has pressed the manual feed button again is detected (step S25).

If step S25 determines that the user has not pressed the manual feed button 17 (step S25 returns No), control returns to step S24 and waiting continues.

If step S25 determines that the user has pressed the manual feed button 17 (step S25 returns Yes), the controller 36 returns to step S22, again controls the paper transportation unit 35 to advance the roll paper 20, and the process repeats.

If step S24 determines that the prescribed standby time has passed (step S24 returns Yes), the controller 36 controls the automatic paper cutter 34 to partially cut the roll paper 20 as described above (step S26) so that the paper can be easily separated and removed by the user.

When the user intentionally or accidentally releases the manual feed button 17, this aspect of the invention enables the user to press the manual feed button 17 again within a prescribed time so that the paper is advanced according to how many times the manual feed button is pressed and is then automatically cut. The paper can therefore be easily cut to the desired length.

The paper is advanced a prescribed length when the manual feed button 17 is pressed and is then always automatically cut. Alternatively, however, the process executed when the manual feed button 17 is operated could have an operating mode as described above and another operating mode in which the paper is only advanced, and which of these modes is used could be made selectable by the user.

When the operating mode that effects the operation of the foregoing embodiment is selected, whether the process shown in FIG. 6 or the process shown in FIG. 7 is used can also be made user selectable.

Further alternatively, the paper could be advanced a prescribed length and then cut when the manual feed button 17 is operated only once so that the user does not need to continue holding the manual feed button 17.

Further alternatively, if the manual feed button 17 is operated, the paper is advanced a prescribed length, and the manual feed button 17 is still being operated, the paper could be advanced continuously until the manual feed button 17 is no longer operated and then cut.

While the paper cutting position of the automatic paper cutter is not described in detail above, the paper is preferably cut so that leading end of the roll paper in the printer is left inside the printer so that the user is forced to press the manual feed button 17 in order to remove a length of paper from the roll.

A manual feed button 17 is described above as the prescribed actuator, but a separate actuator for effecting the operation described above can be provided.

The printer 1 described above is an inkjet printer that uses four colors of ink, black, cyan, magenta, and yellow, but the invention is not so limited. For example, additional dark and light colored inks can be used in addition to these four colors. Further alternatively, the printer could use only two colors of ink, such as black and red. Yet further alternatively, the printer could use only a single color of ink, such as black.

An inkjet printer is used by way of example as the printer 1 in the foregoing embodiment, but other types of printers can be used instead. For example, a printer that uses a piezoelectric actuator to discharge ink, or a bubble printer that energizes a heater to discharge ink by bubbles formed inside the ink path, could be used.

The printer 1 could further alternatively be a dot impact printer, or a compact laser printer.

The invention is also not limited to using the printer 1 connected to an external host computer as described above. For example, the invention can be used in an image recording apparatus that is built in to or assembled in a specialized device that has host computer functions.

The printer 1 forms the functional units shown in FIG. 4 by the cooperation of hardware and software components, and the specific arrangement of the hardware and software components can be achieved in various ways. The specific detailed arrangement of the printer 1 can also be varied in many ways.

The control program that achieves the functions described above is typically stored in ROM, but the control program can be recorded to any recording medium that can be read by a computer (CPU). This enables the computer to read the program from the recording medium and execute the steps of the program to achieve the same operation and effect described above.

Any desirable recording medium can be used, including RAM, ROM, or other type of semiconductor memory, a floppy disk, hard disk, or other type of magnetic storage medium, a CD, CDV, LD, DVD, or other type of optically readable recording medium, a magneto-optical disc or other type of magnetically writable/optically readable storage medium, or any other type of computer-readable storage medium that can be read using any type of electronic, magnetic, optical, or other type of reading method.

The control program can also be downloaded and installed using a communication interface and a communication network such as the Internet or a LAN.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A control method for a printer that uses roll paper as printing paper and has an automatic paper cutter, comprising:

determining if a prescribed actuator is operated at an initial time;

discharging a prescribed length of the printing paper from a paper exit of the printer when the prescribed actuator is operated at the initial time;

determining if the prescribed actuator is not operated after the prescribed length of the printing paper has been discharged; and determining if a prescribed time has passed since the prescribed actuator is not operated;

discharging the printing paper again if the prescribed actuator is operated within the prescribed time; and automatically cutting the printing paper by the automatic paper cutter after paper transportation ends if the prescribed actuator is not operated within the prescribed time.

2. The method described in claim 1, wherein:

when the prescribed actuator is operated at the initial time, which causes the printing paper to be discharged the prescribed length, and when the prescribed actuator is still being operated, the printing paper continues to be advanced until the prescribed actuator is not operated.

3. The method described in claim 1, wherein the paper is cut so that a leading end of the printing paper remains inside the printer.

4. A control program stored on a non-transitory computer-readable medium that when executed causes a computer to perform a control method, whereby the computer controls a printer that uses roll paper as printing paper and has an automatic paper cutter, the control method comprising:

determining if a prescribed actuator is operated at an initial time;

discharging a prescribed length of the printing paper from a paper exit of the printer when the prescribed actuator is operated at the initial time;

determining if the prescribed actuator is not operated at the initial time; and determining if a prescribed time has passed since the prescribed actuator is not operated after the prescribed length of the printing paper has been discharged;

discharging the printing paper again if the prescribed actuator is operated within the prescribed time; and automatically cutting the printing paper by the automatic paper cutter after paper transportation ends if the prescribed actuator is not operated within the prescribed time.

5. A printer that uses roll paper as printing paper comprising:

a paper feeder configured to feed the roll paper;

an automatic paper cutter that has a motor as a drive power source and that is configured to cut the roll paper;

a controller configured to control the paper feeder and the automatic paper cutter; and an operation button for the printer, wherein:

when the operation button is pushed, the controller is configured to control the paper feeder to feed a prescribed length of the roll paper predetermined before the operation button is pushed, and the controller is configured to control the automatic paper cutter to then cut the roll paper, after the operation button is pushed, the operation button is released, and when the operation button is pushed again within a prescribed time after the operation button has been released, the controller is configured to control the paper feeder to again advance the roll paper the prescribed length before the roll paper is cut by the automatic paper cutter, and when the operation button is not pushed again within the prescribed time after the operation button has been released, the controller is configured to control the automatic paper cutter to cut the roll paper.

* * * * *